US011401724B2

(12) United States Patent
Morrow

(10) Patent No.: US 11,401,724 B2
(45) Date of Patent: Aug. 2, 2022

(54) BELOW GRADE FLUID CONTAINMENT

(71) Applicant: Blue Tomato, LLC, Provo, UT (US)

(72) Inventor: Brian D. Morrow, Provo, UT (US)

(73) Assignee: BLUE TOMATO LLC, Provo, UT (US)

( * ) Notice: Subject to any disclaimer, the term of this patent is extended or adjusted under 35 U.S.C. 154(b) by 437 days.

(21) Appl. No.: 16/653,579

(22) Filed: Oct. 15, 2019

(65) Prior Publication Data

US 2021/0040759 A1 Feb. 11, 2021

Related U.S. Application Data

(60) Provisional application No. 62/746,118, filed on Oct. 16, 2018.

(51) Int. Cl.

| | |
|---|---|
| ***E04H 4/14*** | (2006.01) |
| ***E02D 29/045*** | (2006.01) |
| ***E02B 1/00*** | (2006.01) |

(52) U.S. Cl.

CPC ..... *E04H 4/14* (2013.01); *E02B 1/00* (2013.01); *E02D 29/045* (2013.01)

(58) Field of Classification Search

CPC ..... E04H 4/14
USPC ..... 4/506, 488, 513
See application file for complete search history.

(56) References Cited

U.S. PATENT DOCUMENTS

| | | | |
|---|---|---|---|
| 2,202,783 | A | 5/1940 | Morrell |
| 2,321,567 | A | 6/1943 | Wilson |
| 2,844,848 | A | 7/1958 | Couse et al. |
| 3,236,014 | A | 2/1966 | Edgar |
| 3,284,980 | A | 11/1966 | Dinkel |
| 3,310,917 | A | 3/1967 | Simon |
| 3,353,315 | A | 11/1967 | Barker |
| 3,374,703 | A | 3/1968 | Davis et al. |
| 3,517,468 | A | 6/1970 | Woods |

(Continued)

FOREIGN PATENT DOCUMENTS

| | | |
|---|---|---|
| DE | 3034601 A1 | 4/1982 |
| FR | 2359942 | 2/1978 |

(Continued)

OTHER PUBLICATIONS

Notice of Allowance received for U.S. Appl. No. 16/942,166, dated Nov. 23, 2021, 8 pages.

(Continued)

*Primary Examiner* — Lori L Baker
(74) *Attorney, Agent, or Firm* — Workman Nydegger

(57) ABSTRACT

Below grade fluid containment structures, which may include a foam floor and a foam wall extending upward from the floor, the foam wall being formed from foam panels. A granular material is provided for reducing hydraulic soil pressure against an exterior face of the foam wall that would otherwise be exerted by the soil, if the soil were allowed to be positioned up against the foam, particularly the foam wall. The well-draining granular material may be gravel, crushed stone, or the like, which provides better drainage as compared to the surrounding soil material. The interior face of the foam is coated with an elastomeric abrasion resistant impact resistant polymeric coating that seals the below grade interior space defined between the floor and the wall in a seamless water-tight configuration.

20 Claims, 5 Drawing Sheets

(56) References Cited

U.S. PATENT DOCUMENTS

| | | | |
|---|---|---|---|
| 3,529,390 | A | 9/1970 | Stetter |
| 3,646,715 | A | 3/1972 | Pope |
| 3,699,731 | A | 10/1972 | Arnold |
| 3,775,916 | A | 12/1973 | Bair |
| 3,808,085 | A | 4/1974 | Givens |
| 3,888,055 | A | 6/1975 | Gallo |
| 4,035,972 | A | 7/1977 | Timmons |
| 4,435,928 | A | 3/1984 | Huling |
| 4,443,988 | A | 4/1984 | Coutu, Sr. |
| 4,578,909 | A | 4/1986 | Henley et al. |
| 4,578,915 | A | 4/1986 | Schneller |
| 4,615,448 | A | 10/1986 | Johnstonbaugh |
| 4,617,219 | A | 10/1986 | Schupack |
| 4,641,468 | A | 2/1987 | Slater |
| 4,774,794 | A | 10/1988 | Grieb |
| 4,893,451 | A | 1/1990 | Valente |
| 4,944,416 | A | 7/1990 | Petersen |
| 5,003,742 | A | 4/1991 | Dettbarn |
| 5,030,502 | A | 7/1991 | Teare |
| 5,062,387 | A | 11/1991 | Anderson |
| 5,121,578 | A | 6/1992 | Holz |
| 5,138,803 | A | 8/1992 | Grossen |
| 5,172,532 | A | 12/1992 | Gibbar |
| 5,173,233 | A | 12/1992 | Kafarowski |
| 5,181,353 | A | 1/1993 | Harrington |
| 5,231,813 | A | 8/1993 | Drawdy |
| 5,268,226 | A | 12/1993 | Sweeney |
| 5,353,560 | A | 10/1994 | Heydon |
| 5,353,562 | A | 10/1994 | Decker |
| 5,377,470 | A | 1/1995 | Hebinck |
| 5,390,462 | A | 2/1995 | Kreiter |
| 5,403,062 | A | 4/1995 | Sjostedt et al. |
| D384,108 | S | 9/1997 | Rinicella |
| 5,694,730 | A | 12/1997 | Del et al. |
| 5,803,964 | A | 9/1998 | Scarborough |
| 5,822,940 | A | 10/1998 | Carlin et al. |
| 5,899,037 | A | 5/1999 | Josey |
| 5,901,522 | A | 5/1999 | Slater |
| 5,921,046 | A | 7/1999 | Hammond, Jr. |
| 5,927,032 | A | 7/1999 | Record |
| 5,950,389 | A | 9/1999 | Porter |
| D444,577 | S | 7/2001 | Neuhofer |
| 6,305,135 | B1 | 10/2001 | Inaba |
| 6,324,809 | B1 | 12/2001 | Nelson |
| 6,460,302 | B1 | 10/2002 | Neuhaus |
| 6,470,632 | B1 | 10/2002 | Smith |
| 6,481,172 | B1 | 11/2002 | Porter |
| 6,571,523 | B2 | 6/2003 | Chambers |
| D477,423 | S | 7/2003 | Campbell |
| 6,701,683 | B2 | 3/2004 | Messenger |
| 6,772,890 | B2 | 8/2004 | Campbell |
| 6,985,832 | B2 | 1/2006 | Saebi |
| 7,028,440 | B2 | 4/2006 | Brisson |
| 7,036,196 | B2 | 5/2006 | Salatin |
| 7,093,726 | B1 | 8/2006 | Holztrager |
| 7,165,374 | B2 | 1/2007 | Ohanesain |
| 7,712,265 | B2 * | 5/2010 | Overmyer, Jr. ..... E04B 1/161 52/309.7 |
| 7,779,600 | B1 | 8/2010 | Saebi |
| 7,913,730 | B2 | 3/2011 | Schaffeld |
| 8,151,539 | B2 | 4/2012 | Grinsted |
| 8,220,648 | B2 | 7/2012 | Barkdoll |
| 8,468,767 | B1 | 6/2013 | McBride |
| 8,627,625 | B2 | 1/2014 | Bouchard |
| 8,695,299 | B2 | 4/2014 | Propst |
| 9,234,355 | B2 | 1/2016 | Sealock et al. |
| D861,194 | S | 9/2019 | Morrow |
| 10,450,736 | B2 | 10/2019 | Morrow |
| 10,865,560 | B1 | 12/2020 | Morrow |
| 2005/0284060 | A1 | 12/2005 | Ritchie |
| 2006/0046068 | A1 | 3/2006 | Barancyk et al. |
| 2006/0207479 | A1 | 9/2006 | Hughes |
| 2007/0131308 | A1 | 6/2007 | Martin |
| 2008/0282632 | A1 | 11/2008 | Sleeman |
| 2009/0100780 | A1 | 4/2009 | Mathis et al. |
| 2009/0205277 | A1 | 8/2009 | Gibson |
| 2010/0011699 | A1 | 1/2010 | Weimer et al. |
| 2010/0083590 | A1 | 4/2010 | Wochnik |
| 2010/0095625 | A1 | 4/2010 | Boutaghou et al. |
| 2010/0136269 | A1 | 6/2010 | Andersen |
| 2011/0067331 | A1 | 3/2011 | Grinsted |
| 2011/0173911 | A1 | 7/2011 | Propst |
| 2011/0214374 | A1 | 9/2011 | Propst |
| 2012/0011793 | A1 | 1/2012 | Clark et al. |
| 2013/0008129 | A1 | 1/2013 | Hall |
| 2013/0086850 | A1 | 4/2013 | Morrow |
| 2013/0216760 | A1 | 8/2013 | Bol |
| 2013/0227902 | A1 | 9/2013 | Van et al. |
| 2013/0266370 | A1 | 10/2013 | Gunther |
| 2014/0250827 | A1 | 9/2014 | Gillman |
| 2015/0135634 | A1 | 5/2015 | Hoie et al. |
| 2016/0014995 | A1 | 1/2016 | Bruno |
| 2016/0208489 | A1 | 7/2016 | Gibson |
| 2017/0096825 | A1 | 4/2017 | Bree |
| 2017/0121958 | A1 | 5/2017 | Jin |
| 2017/0211268 | A1 | 7/2017 | Eichhorn et al. |
| 2018/0298600 | A1 | 10/2018 | Moss et al. |
| 2019/0242109 | A1 | 8/2019 | Morrow |
| 2020/0001583 | A1 | 1/2020 | Eichhorn et al. |
| 2020/0354945 | A1 | 11/2020 | Morrow |
| 2021/0040722 | A1 | 2/2021 | Morrow |
| 2021/0040733 | A1 | 2/2021 | Morrow |
| 2021/0301528 | A1 | 9/2021 | Dombowsky et al. |

FOREIGN PATENT DOCUMENTS

| | | |
|---|---|---|
| GB | 2261234 | 5/1993 |
| JP | 07-102680 | 4/1995 |
| JP | 10148095 | 6/1998 |
| JP | 2002-292612 | 10/2002 |
| KR | 10-1993-0010328 | 6/1993 |
| KR | 10-2009-0065909 | 6/2009 |
| WO | 2013052427 | 4/2013 |
| WO | 2018/194528 A1 | 10/2018 |
| WO | 2021/118744 | 6/2021 |

OTHER PUBLICATIONS

U.S. Appl. No. 13/436,403, filed Mar. 30, 2012.
U.S. Appl. No. 62/722,591, filed Aug. 24, 2018.
U.S. Appl. No. 62/890,818, filed Aug. 23, 2019.
U.S. Appl. No. 62/991,889, filed Mar. 19, 2020.
U.S. Appl. No. 16/942,166, filed Jul. 29, 2020.
U.S. Appl. No. 29/744,477, filed Jul. 29, 2020.
Final Office Action received for U.S. Appl. No. 16/549,901, dated Mar. 12, 2021, 6 pages.
Non-Final Office Action received for U.S. Appl. No. 16/824,209, dated Jul. 29, 2021, 13 pages.
Notice of Allowance received for U.S. Appl. No. 16/549,901, dated Apr. 16, 2021, 8 pages.
U.S. Appl. No. 13/866,569, filed Apr. 19, 2013, Morrow.
U.S. Appl. No. 15/426,756, filed Feb. 7, 2017, Morrow.
U.S. Appl. No. 16/549,901, filed Aug. 23, 2019, Morrow.
U.S. Appl. No. 29/648,685, filed May 23, 2018, Morrow.
U.S. Appl. No. 29/658,417, filed Jul. 31, 2018, Morrow.
International Search Report for PCT/US2012/058344 dated Mar. 28, 2013,3 pages.
U.S. Appl. No. 13/436,403, Feb. 13, 2013, Office Action.
U.S. Appl. No. 13/436,403, Aug. 1, 2013, Final Office Action.
U.S. Appl. No. 13/866,569, Jun. 20, 2014, Notice of Allowance.
U.S. Appl. No. 15/426,756, Feb. 23, 2018, Office Action.
U.S. Appl. No. 29/648,685, Feb. 15, 2019, Ex Parte Quayle Action.
U.S. Appl. No. 29/648,685, May 9, 2019, Notice of Allowance.
Non-Final Office Action received for U.S. Appl. No. 16/549,901, dated Sep. 4, 2020.
Office Action received for U.S. Appl. No. 15/987,366, dated Feb. 14, 2019.
Office Action received for U.S. Appl. No. 16/709,674, dated Apr. 6, 2020.

(56) References Cited

OTHER PUBLICATIONS

U.S. Application filed on Mar. 19, 2020 by Morrow., U.S. Appl. No. 16/824,209.

* cited by examiner

BELOW GRADE FLUID CONTAINMENT

CROSS-REFERENCE TO RELATED APPLICATION

This application claims the benefit under 35 U.S.C. 119(e) of U.S. Provisional Application No. 62/746,118 (18944.17), filed Oct. 16, 2018, which is entitled BELOW GRADE FLUID CONTAINMENT, which is herein incorporated by reference in its entirety.

BACKGROUND OF THE INVENTION

1. The Field of the Invention

The present invention is in the field of construction methods and systems used in constructing swimming pools, as well as other below grade fluid containment structures, particularly with a modular construction system.

2. The Relevant Technology

Building construction systems including modular features are sometimes used in the construction field, although such systems rarely if ever are used in construction of swimming pools or other below grade fluid containment structures. For example, typically such structures are made out of precast concrete or constructed using rebar reinforcement, which is then covered over with shotcrete.

Existing construction systems and methods for constructing such below grade fluid containment structures continue to exhibit various drawbacks, at least some of which can be improved upon by the systems and methods disclosed herein.

SUMMARY

The present invention is directed to below grade fluid containment structures, such as swimming pools, septic tanks, biodigesters, or other below grade structures that may be filled with water or other liquid. One embodiment may include a foam floor, a foam wall extending upward from the floor, where the foam wall and/or foam floor are formed from foam panels. Such foam (e.g., expanded polystyrene) is lightweight, with a density of about 1 lb/ft$^3$ (e.g., from 1 to 10 lb/ft$^3$). The foam panels may be such as those described in Applicant's U.S. Pat. No. 10,450,736 (18944.10.2), D861,194 (18944.11), 62/890,818 (18944.18.1) and Ser. No. 16/549,901 (18944.13.1), each of which is incorporated herein by reference in its entirety. The containment structure may further include a granular material (e.g., gravel, crushed stone, or the like) for reducing hydraulic soil pressure against an exterior face of the foam wall. The granular material may be positioned on the exterior surface of the foam wall (i.e., on the outside thereof, against the wall), so as to be between the foam wall and soil (i.e., dirt) that defines the grade. An interior face of the foam wall is further coated with a polymeric coating. This coating may be elastomeric (e.g., a polymeric elastomer), abrasion resistant, and impact resistant. The coating seals a below grade interior space defined between the floor and the wall in a seamless water-tight configuration.

Individual features from any of the embodiments disclosed herein may be used in combination with one another, without limitation. In addition, these and other benefits and features of the present invention will become more fully apparent from the following description and appended claims or may be learned by the practice of the invention as set forth hereinafter.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

DETAILED DESCRIPTION OF THE PREFERRED EMBODIMENTS

I. Definitions

Figure 1:
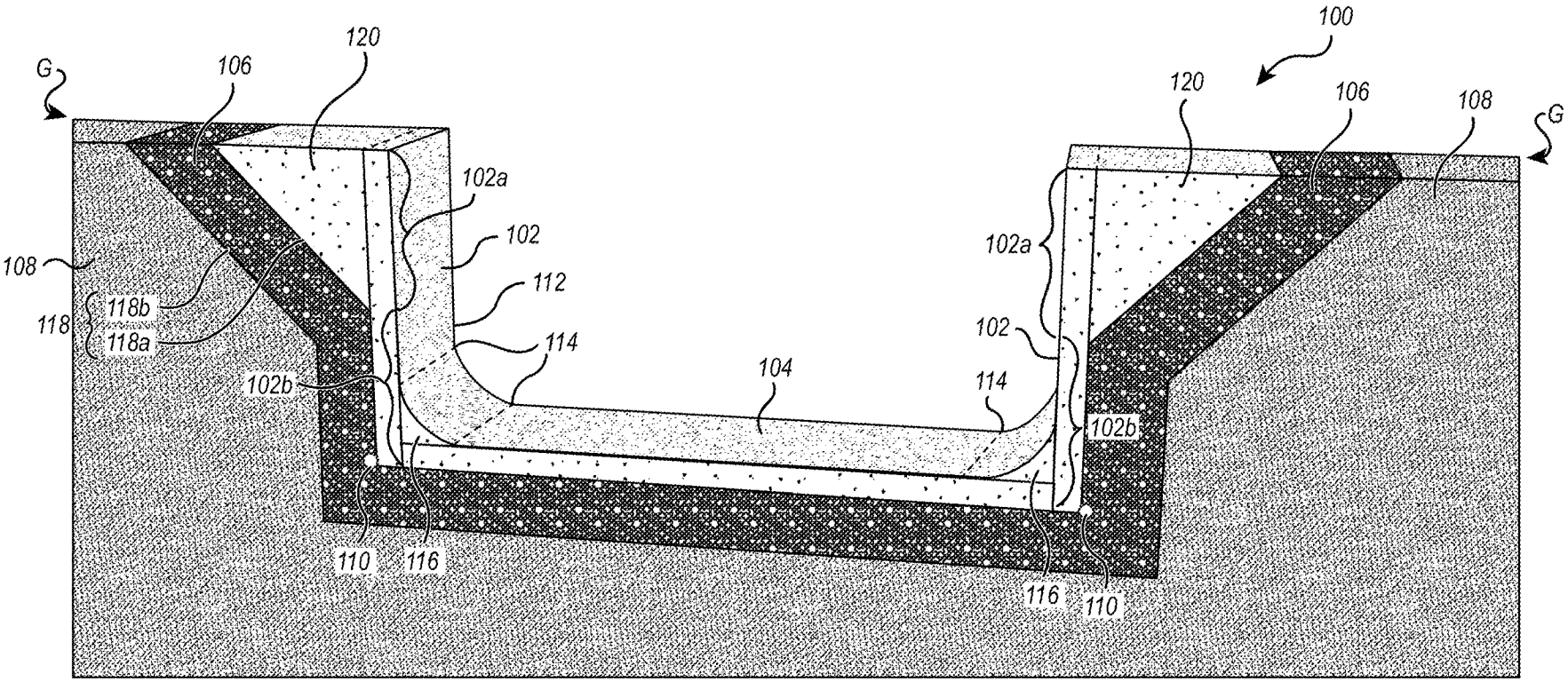
FIG. 1 illustrates a cross-section through an exemplary construction scheme for a below grade fluid containment structure according to the present invention.
Figure 2:
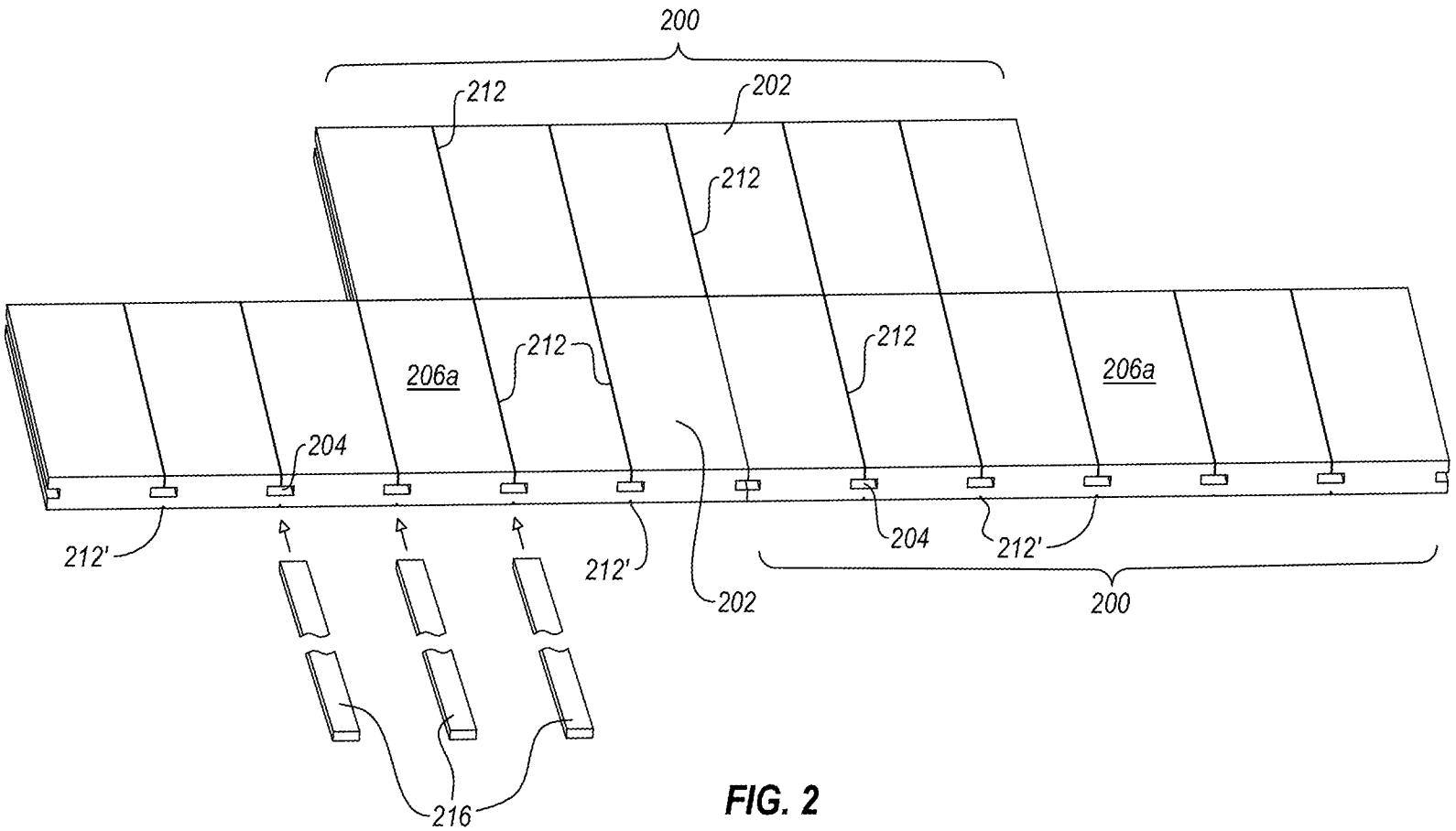
FIGS. 2-5 illustrate exemplary foam panels and splines that may be used in construction of a below grade fluid containment structure according to the present invention.
Figure 3:
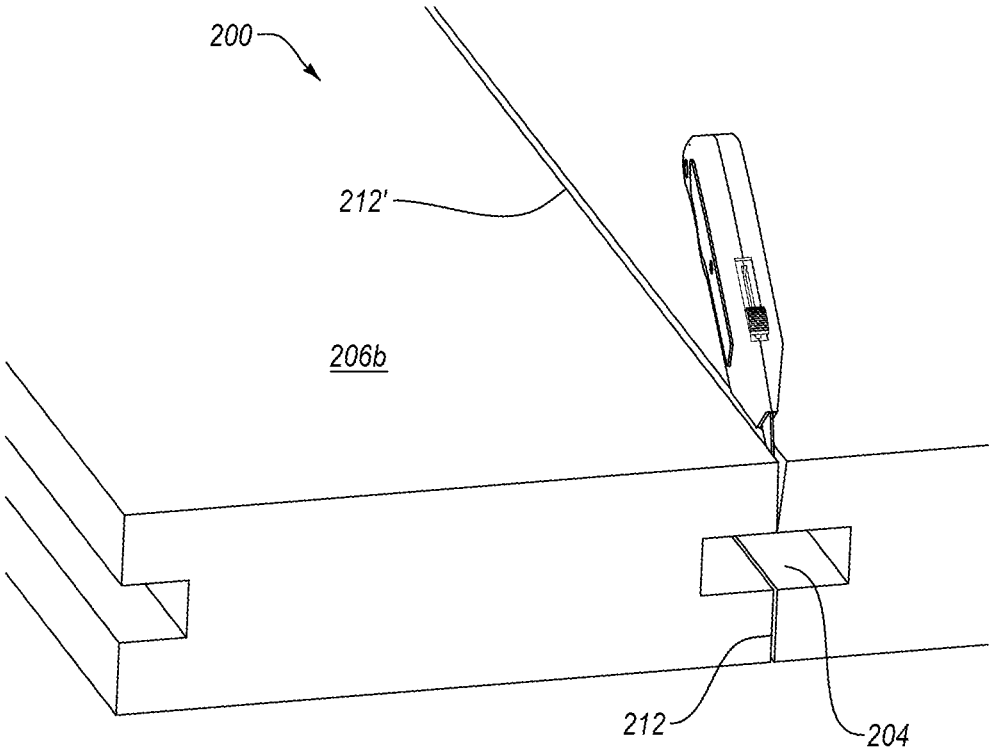
Figure 4:
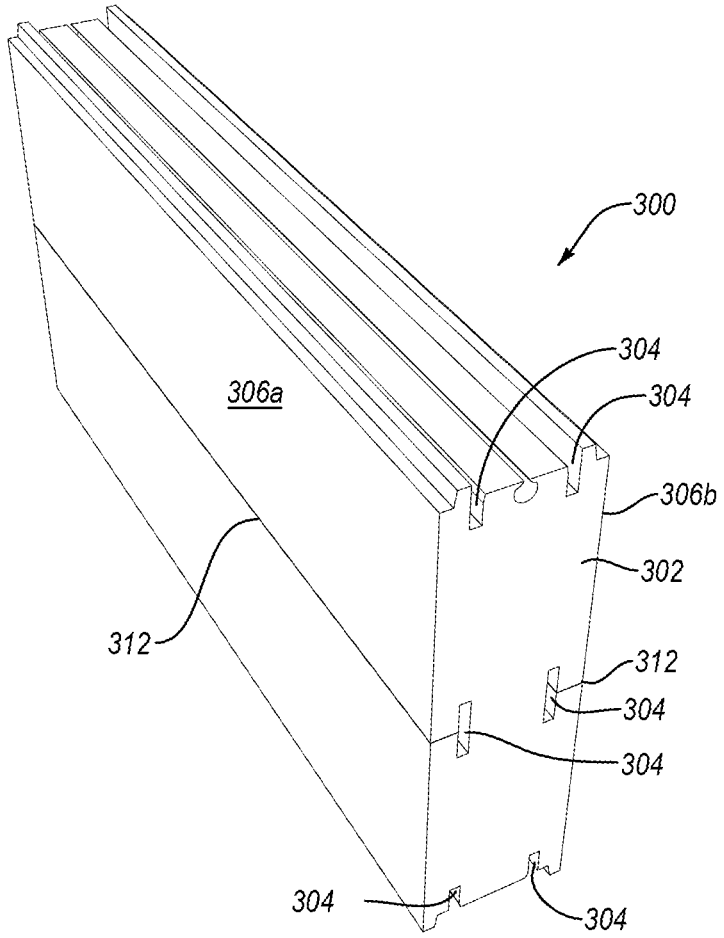
Figure 5:
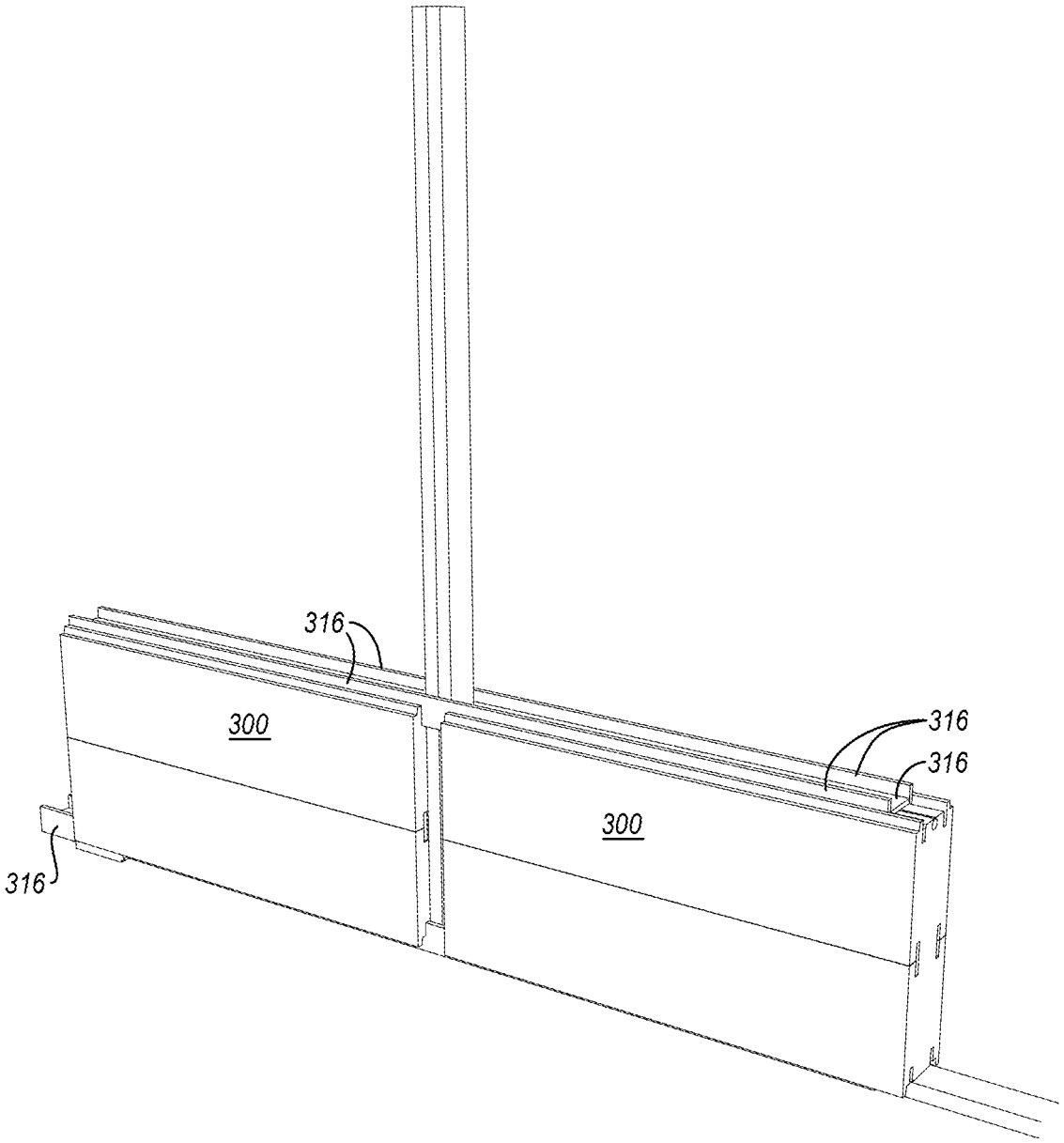

All publications, patents and patent applications cited herein, whether supra or infra, are hereby incorporated by reference in their entirety to the same extent as if each individual publication, patent or patent application was specifically and individually indicated to be incorporated by reference.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise.

Numbers, percentages, ratios, or other values stated herein may include that value, and also other values that are about or approximately the stated value, as would be appreciated by one of ordinary skill in the art. As such, all values herein are understood to be modified by the term "about". A stated value should therefore be interpreted broadly enough to encompass values that are at least close enough to the stated value to perform a desired function or achieve a desired result, and/or values that round to the stated value. The stated values include at least the variation to be expected in a typical manufacturing process, and may include values that are within 10%, within 5%, within 1%, etc. of a stated value. Furthermore, where used, the terms "substantially", "similarly", "about" or "approximately" represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In some embodiments, the methods or articles described herein may be free or a substantially free from any specific steps or components not mentioned within this specification.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In one embodiment, the present invention is directed to below grade fluid containment structures, such as swimming pools, septic tanks, biodigesters, or other below grade structures that may be filled with water or other liquid. One embodiment may include a foam floor, a foam wall extending upward from the floor, where the foam wall and/or foam floor are formed from foam panels. The foam panels may be such as those described in Applicant's U.S. Pat. No. 10,450,736 (18944.10.2), D861,194 (18944.11), 62/890,818 (18944.18.1) and Ser. No. 16/549,901 (18944.13.1), each of which is incorporated herein by reference in its entirety. In particular, the foam panels may be pre-cut during manufacture using high precision CNC equipment, so as to be planar on their faces, and with very high accuracy in any given cuts (e.g., within 0.001 inch). This differs from what is possible with spray-in type foam materials, or the like. While the Applicant's foam panels may be preferred, any other foam panel construction may also be used. In an embodiment, no wood would be present in the wall or floor construction. For example, the foam panels may be solid foam, without internal channels, or if splines are desired (e.g., as described in Applicant's references, already incorporated by reference), metal splines could be used.

The containment structure may further include a granular material (e.g., gravel, crushed stone, or the like) for reducing hydraulic pressure against an exterior face of the foam wall. The granular material is positioned on the exterior surface of the foam wall (i.e., on the outside thereof, against the wall), so as to be between the foam wall and soil (i.e., dirt) that defines the grade. An interior face of the foam wall is further coated with a polymeric coating. This coating may be elastomeric, abrasion resistant, and impact resistant. The coating seals a below grade interior space defined between the floor and the wall in a seamless water-tight configuration.

II. Exemplary Fluid Containment Structures

FIG. 1 illustrates an exemplary below grade fluid containment structure 100, such as an "in-ground" swimming pool. It will be appreciated that the cross-sectional width of the pool is shown in FIG. 1, with the length of the pool not shown, as it extends in and out of the page. It will also be appreciated that the system seen in FIG. 1 may also be used to construct other below grade "in-ground" structures, such as septic tanks, biodigesters, or other similar structures that are below grade, meaning below ground level. The top of such a structure may be open, as in a typical outdoor pool, or may be covered, as desired. The top of the containment structure 100 may be approximately flush with "ground level" (e.g., within a foot thereof), or lower. Typically, the top of such containment structures will not extend above ground level, although if a roof covering structure were provided, the roof may be above ground level.

The fluid containment structure 100 differs from traditional construction methods for such structures, as it uses foam to form the walls 102 and floor 104. Preferably, both floor 104 and walls 102 are formed of foam, although conceivably one or the other could be concrete (e.g., a concrete floor) or some other material. That said, there are significant advantages to having the full walls and floor which are positioned below grade, formed of foam, rather than cementitious materials.

The illustrated construction significantly reduces construction time, as it is far easier to excavate the pool or other containment structure below grade, and then position foam panels to provide the floor 104 and walls 102, as opposed to the typical steps used to form a concrete pool construction. As shown, a granular material 106 is provided between the edges (i.e., border) of the excavated soil 108 and the foam panels that are placed in position as floor 104 or walls 102. This granular material 106 serves to reduce hydraulic pressure that would otherwise be applied by the soil, if the soil 108 were allowed to bear directly up against the exterior of the foam walls 102 and floor 104. Such granular material 106 allows water seeping into this region to be quickly carried away through the granular material 106. For example, water drains better through this granular material 106 as compared to the soil 108, particularly where the soil 108 includes a significant clay component. As shown in FIG. 1, one or more French drains 110 or similar drainage may be provided below the floor 104, e.g., in or at the bottom of the granular material layer 106, to carry away such water drainage. Such a configuration reduces hydraulic pressure against the floor 104, and particularly the walls 102, exerted by the soil 108 that defines the "ground level" grade G below which the structure 100 is positioned. The specific construction of French drains 110 and other similar suitable drainage systems will be familiar to those of skill in the art.

The granular material 106 may be gravel, crushed stone, or the like, e.g., typically having an average particle size of less than 3 inches, less than 2 inches, less than 1 inch, or less than 0.5 inch. The average particle size of the granular material may be greater than 1 mm, greater than 2 mm, or greater than 3 mm, e.g., more coarse than sand, although in some embodiments, sand could be used, if desired.

The foam floor 104 and foam walls 102 may typically have a thickness of at least 4 inches, such as 4 inches to 24 inches, 4 inches to 16 inches, or 6 inches to 12 inches (e.g., 9 inches).

Whatever thickness foam is used, the foam panels provide significant insulative characteristics. For example, for expanded polystyrene foam, each inch of foam thickness provides an R value of about 4. For example, 9 inch thick panels would provide an R value of about 36. Such insulation insulates the contents of the fluid containment structure (e.g., pool water, septic tank, biodigester, etc.) 100 from ground temperatures, particularly fluctuations in ground temperature. Perhaps even more importantly, the insulation characteristics of the foam insulate the contents of the structure from the "heat sink" characteristics of the surrounding ground. For example, if a pool is heated, the pool water is heated to a temperature that is greater than the typical ground temperature, and as a result the ground acts as a heat sink, constantly pulling heat away from the pool water, through the pool wall 102 (and floor 104), into the ground (effectively heating the ground with the heated pool water). By using a foam floor 104 and foam wall 102, loss of heat through the wall 102 and/or floor 104 is greatly reduced, which greatly reduces energy costs to maintain the pool at a desired temperature. Similar considerations apply to a biodigester (e.g., where it may be important to maintain the contents of the digester at a given temperature to promote growth and health of the bioculture grown in the biodigester). Similar considerations may apply to a septic tank or other below grade fluid containment structure (e.g., to prevent freezing, etc.).

In the case of a pool or any other structure, such insulation will greatly reduce heating costs as the surrounding soil in a traditional pool acts as a heat sink, drawing heat out of heated pool water or other structure contents. In other words, it is expensive to heat pool water, as the heat is continuously being drawn out of the pool, into the surrounding soil. The foam walls 102 and floor 104 greatly reduce this loss of heat to the soil 108. Whether in the context of a pool, biodigester or other fluid containment, the fluid in the structure can be maintained at a desired temperature more economically.

The foam underground structure is constructed (e.g., foam panels are placed as floor and walls) and then the interior surface of the foam panels of the floor and walls are sprayed or otherwise coated with a polymeric coating 112. This coating 112 provides waterproof characteristics in a manner that coats over any seams (e.g., seams 114) between foam panels of the floor and/or walls, and any foam gussets 116 such as those shown at the bottom edge of the pool or other structure, where the floor 104 and wall 102 intersect.

The foam gussets 116 shown at the bottom of the pool structure, spanning the edge or corner between the floor 104 and wall 102 ensures that no 90° or other angled surface is present at these locations, but instead provides the desired concavely curved interior transition which makes cleaning of the interior of the pool or other containment structure simple. Perhaps more importantly, this internal gusset 116 also provides additional reinforcement to support the soil load that is applied against the lower portion of the vertical wall 102, below that section of the soil and granular material at the angle of repose (at 118). Such a gusset 116 aids in transferring the applied soil load to the floor 104.

The sprayed or otherwise applied coating 112 may provide sufficient impact resistance and rigidity to the foam panels of the floor 104 and wall(s) 102 to resist impacts that may be expected during normal use and operation of such a pool or other structure 100. By way of example, the coating thickness may be greater than 5 mils, and up to 500 mils, although typically no more than 150 mils would be needed (e.g., 6 mils to 150 mils, or 6 mils to 30 mils).

Examples of such coatings include curable polyurethanes and curable polyureas. Such coatings also exhibit some degree of elasticity, which is sufficient that the coating does not crack or otherwise fail over years of use, even when exposed to daily and seasonal temperature, humidity, and other environmental changes. Such a coating may be similar to a truck-bed liner material. The coating water-proofs the interior of the pool or other containment structure 100. The coating may also exhibit non-stick properties, such that dirt, soil, or other materials are easily removed therefrom, e.g., above the water-line, or if drained. Where the pool, digester or septic tank is drained, such coating 112 could be easily cleaned by pressure washing, as desired.

Because of the applied one-piece coating 112, there are no seams or joints that are exposed in the coated boundary of the wall(s) 102, and floor 104 (all of which may be collectively coated with a single piece coating 112). This coating seal allows the interior volume defined by the floor 104 and wall(s) 102 to hold a desired liquid without risk of leaks.

The foam panels used for the floor 104 and wall(s) 102 are typically provided precut, as rigid foam sheet panels, exhibiting near perfect planar characteristics, rather than a spray-in type foam. Such foam panels are described in Applicant's earlier applications, incorporated by reference herein. The rigid, pre-cut, planar characteristics of the foam panels of the walls 102 and floor 104 ensure that the foam panels are flat, which aids in creating a smooth, flat interior surface for the pool or other containment structure 100, after application of the polymeric coating 112.

For example, as described in Applicant's applications already incorporated by reference, such foam panels can typically be cut to an accuracy of 0.001 inch (i.e., 1 mil). Thus, the planar surface may have low surface roughness (e.g., less than 0.1 inch, or no more than 0.001 inch variability in the "normal" direction relative to the plane).

Even though the final coating 112 is applied e.g., by spraying, this surface is relatively thin, and is able to maintain the substantially planar characteristics of the underlying foam, even as the coating is sprayed over, e.g., in a similar manner as a coating of paint.

The floor 104 may be constructed of floor foam panels, similar to those of the walls 102. In another embodiment, a concrete or other floor formed from a material other than foam could conceivably be provided, with foam walls 102 being attached thereto. In any case, the interface between the wall(s) 102 and the floor 104 is sealed with the polyurethane or other polymeric coating 112, which ties the two structures together into a single piece structure. The exterior surface of the foam may also be coated, e.g., before placement of the granular material 106, and/or placement of the coated foam structure into the excavation. For example, in one embodiment, the foam floor 104 and wall(s) 102 could be pre-constructed, e.g., either inside or outside of the excavation, including coating one or both faces of the foam assembly with the polymeric coating 112. If assembled outside of the excavation, the pre-constructed foam assembly can be lowered down into the excavation at some point during construction. For example, in an embodiment, the portion of the granular material layer 106 (e.g., gravel layer) that is below the floor 104 may be laid in the excavated hole, followed by placement or assembly of the floor 104 thereover. Individual foam panels for the floor 104 and walls 102, gussets 116, and buttresses 120 may be attached to one another using an adhesive suitable for such purpose, e.g., as disclosed in Applicant's earlier filed applications. With individual foam panels adhered to one another, the assembly of foam panels can then be oversprayed with the polymeric coating 112. The polymeric coating 112 can be tinted to any color or other types of coatings can be applied to add UV stability, color, etc.

At least a portion of the exterior of the foam assembly may be coated with the coating 112, as well as the entire interior of the foam assembly. For example, at least the lower portion of the exterior of the foam assembly, below the foam buttress 120 on the outside of the upper portion of the wall 102. Of course, even this upper portion may also be coated, if desired.

With the foam floor and foam wall(s) in place, the vertically oriented portions of the granular material 106 may be backfilled, e.g., by pouring gravel or other well-draining granular material 106 into the space between the soil boundary defined by the excavation and the foam material. As shown in FIG. 1, an upper portion 118*a* of the vertically oriented portion of the granular material layer 106 may be diagonally angled, e.g., at, close to, or more shallow in angle than the applicable angle of repose of the soil material that the excavation is formed in. For example, for typical soils, the angle of repose (i.e., that angle or incline that the soil can maintain without falling) may be from 30° to 45°. As illustrated, the upper portion of the wall(s) 102 may further include a foam buttress 120 as shown that is attached to the vertical portion of the foam wall 102, on the exterior face of the foam wall 102, e.g., flush or nearly flush with the top of the wall 102. The foam buttress 120 may be triangular in shape, as shown. The underside of the buttress 120 may be cut to the desired angle of repose 118*a*, e.g., so as to aid the upper portion of the granular material 106 and the soil 108 to assume this same angle of repose (at 118*a*, and 118*b*, respectively). As noted above, this greatly reduces any load applied by the soil 108 to this portion of the foam assembly.

Where the angle is set at 45°, this will result in the soil along the upper half of the excavation being positioned at the angle of repose, such that this portion of the excavation applies substantially no load to the upper half of the wall of the containment structure 100. In other words, there may be substantially no inward soil load on the triangular foam buttress 120, or on the adjacent upper portion (102*a*) of the vertical wall 102. Thus, the only load applied on the vertical wall 102 may be due to that portion of soil 108 (and granular material backfill 106) on the lower half (102*b*) of the vertical wall 102. Because of the inclusion of the angled buttress 120 which removes much of the soil load that would otherwise be present, no structural steel, concrete, or other materials stronger than the foam are needed.

Where the interior and at least a portion of the exterior faces of the foam assembly of the floor 104 and wall(s) 102 are coated with the polymeric coating material, the entire foam assembly becomes a monocot structure, acting as a monocot, integral single structure, rather than an assembly of separate wall and floor panels (which can be separated and break apart at their attachment points).

The system and method advantageously does not require any heavy equipment for construction. For example, no cranes, no cement trucks, no cement or concrete, no cutting of steel rebar, no concrete spraying (shotcrete) equipment or the like are needed. For example, the present system and method may reduce cost and/or time to fabricate an in-ground pool or other below grade containment structure by about ⅔, which is very significant.

Each of applicant's U.S. patent application Ser. Nos. 13/866,569, 13/436,403; 15/426,756 (18944.9), 62/890,818 (18944.18.1); Ser. No. 16/549,901 (18944.13.1) and Applicant's U.S. Pat. Nos. 10,450,736 (18944.10.2) and D861, 194 (18944.11), is each incorporated by reference in its entirety. For example, as shown in FIGS. 2-5 (taken from U.S. Pat. No. 10,450,736 (18944.10.2) and Application 62/890,818 (18944.18.1), the panels 200, 300 may include a body 202, 302, with a plurality of channels 204, 304 extending through a length or width of the panel, each channel being configured to receive a spline 216, 316 therein, wherein each spline once received in the channel is disposed within the body, without the spline being exposed on an outside face of the body, so that the spline is restrained once received within the channel. The body 202 302 may be formed from foam, and the foam body may be generally rectangular in shape. The foam body may include a pre-cut slot 212, 312 in a first face 206*a*, 306*a* of the panel, the pre-cut slot 212, 312 being centered on a respective channel 204, 304, extending through the first face 206*a*, 306*a* into the channel 204, 304. The foam body may include a score line 212' or pre-cut slot 312 in an opposite second face 206*b*, 306*b* of the panel, aligned with a corresponding pre-cut slot 212, 312 in the first face 206*a*, 306*a*, such that the thickness of the foam beneath the score line or adjacent the pre-cut slot in the second face is less than half the thickness of the foam body as defined between the first face of the panel and the opposite second face of the panel.

If desired, cementitious panels such as those described in Applicant's U.S. patent application Ser. No. 15/426,756 (18944.9) and 62/722,591 (18944.13) or Ser. No. 16/549,901 (18944.13.1) could be applied over the interior or exterior faces of the foam panels of the wall 102 or floor 104. Such panels can provide improved impact resistance, as compared to the underlying foam wall panels, should such be desired.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A below grade fluid containment structure comprising:

a foam floor;

a foam wall extending upward from the floor, the foam wall being formed from foam panels;

a granular material for reducing hydraulic soil pressure against an exterior face of the foam wall, the granular material being positioned to the exterior surface of the foam wall, between the foam wall and soil, an upper surface of which soil defines the grade;

wherein an interior face of the foam wall is coated with an elastomeric, abrasion resistant, and impact resistant polymeric coating that seals a below grade interior space defined between the floor and the wall in a seamless, water-tight configuration.

2. A below grade fluid containment structure as recited in claim 1, wherein the granular material comprises at least one of gravel or crushed stone.

3. A below grade fluid containment structure as recited in claim 1, wherein the polymeric coating comprises a two-part curable polymeric composition.

4. A below grade fluid containment structure as recited in claim 3, wherein the two-part curable polymeric composition is a two-part polyurethane coating or a two-part polyurea coating.

5. A below grade fluid containment structure as recited in claim 4, wherein the two-part polyurethane coating or two-part polyurea coating is applied to have a thickness greater than 5 mils.

6. A below grade fluid containment structure as recited in claim 5, wherein the two-part polyurethane coating or two-part polyurea coating is applied to have a thickness from 6 mils to 150 mils.

7. A below grade fluid containment structure as recited in claim 5, wherein the two-part polyurethane coating or two-part polyurea coating is applied to have a thickness from 6 mils to 30 mils.

8. A below grade fluid containment structure as recited in claim 4, wherein the two-part polyurethane coating or two-part polyurea coating provides elasticity upon curing.

9. A below grade fluid containment structure as recited in claim 8, wherein the two-part polyurethane coating or two-part polyurea coating provides non-stick properties.

10. A below grade fluid containment structure as recited in claim 1, further comprising a foam gusset positioned in a corner defined between the floor and the wall.

11. A below grade fluid containment structure as recited in claim 1, further comprising a foam buttress positioned adjacent a top of the foam wall, against the exterior face of the foam wall, the foam buttress being shaped to reduce soil load by putting soil at an angle that approximates an angle of repose for the soil.

12. A below grade fluid containment structure as recited in claim 11, wherein the foam buttress is shaped to provide an angle from 30° to 45°.

13. A below grade fluid containment structure as recited in claim 1, wherein the exterior face of the foam wall is also coated with the polymeric coating.

14. A below grade fluid containment structure as recited in claim 1, wherein the floor and wall do not include any shotcrete or other concrete.

15. A below grade fluid containment structure as recited in claim 14, wherein the floor and wall do not include any rebar reinforcement.

16. A below grade fluid containment structure as recited in claim 1, wherein the below grade fluid containment structure is an in-ground swimming pool or a septic tank.

17. A below grade fluid containment structure as recited in claim 1, further comprising a french drain below the foam floor.

18. A below grade fluid containment structure as recited in claim 1, wherein the walls are constructed using a plurality of foam panels.

19. A below grade fluid containment structure as recited in claim 1, wherein the walls are constructed using a system of modular foam panels and splines, wherein the modular foam panels comprise:

a body;

a plurality of channels extending through a length or width of the panel, each channel being configured to receive a spline therein, wherein each spline once received in the channel is disposed within the body, without the spline being exposed on an outside face of the body, so that the spline is restrained once received within the channel;

wherein the body comprises foam, and the foam body is generally rectangular in shape, the foam body further comprising a pre-cut slot in a first face of the panel, the pre-cut slot being centered on a respective channel, extending through the first face into the channel, the foam body further comprising a score line or pre-cut slot in an opposite second face of the panel, aligned with a corresponding pre-cut slot in the first face, such that the thickness of the foam beneath the score line or adjacent the pre-cut slot in the second face is less than half the thickness of the foam body as defined between the first face of the panel and the opposite second face of the panel.

20. A below grade fluid containment structure as recited in claim 1, wherein the foam floor and foam wall are constructed from rigid foam panels of 1 $lb/ft^3$ or greater density foam.

* * * * *